US008999075B2

(12) United States Patent
Matsutani et al.

(10) Patent No.: US 8,999,075 B2
(45) Date of Patent: Apr. 7, 2015

(54) COMPOSITE MAGNETIC MATERIAL AND PROCESS FOR PRODUCTION

(75) Inventors: Nobuya Matsutani, Osaka (JP); Takeshi Takahashi, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/700,675

(22) PCT Filed: Jun. 28, 2011

(86) PCT No.: PCT/JP2011/003666

§ 371 (c)(1), (2), (4) Date: Nov. 28, 2012

(87) PCT Pub. No.: WO2012/001943

PCT Pub. Date: Jan. 5, 2012

(65) Prior Publication Data

US 2013/0136933 A1 May 30, 2013

(30) Foreign Application Priority Data

Jun. 30, 2010 (JP) ..... 2010-148739

(51) Int. Cl.

| | |
|---|---|
| ***H01F 41/02*** | (2006.01) |
| ***C22C 33/02*** | (2006.01) |
| ***C22C 38/34*** | (2006.01) |
| ***H01F 1/26*** | (2006.01) |

(52) U.S. Cl.

CPC ..... *H01F 41/0266* (2013.01); *B22F 2998/10* (2013.01); *B22F 2999/00* (2013.01); *C22C 33/0278* (2013.01); *C22C 38/34* (2013.01); *C22C 2202/02* (2013.01); *H01F 1/26* (2013.01); *H01F 41/0246* (2013.01)

(58) Field of Classification Search

USPC ..... 148/104–105, 300, 307, 309

See application file for complete search history.

(56) References Cited

U.S. PATENT DOCUMENTS

| | | | | |
|---|---|---|---|---|
| 5,238,507 | A * | 8/1993 | Kugimiya et al. | 148/307 |
| 5,352,522 | A * | 10/1994 | Kugimiya et al. | 428/403 |
| 6,312,531 | B1 | 11/2001 | Matsutani et al. | |
| 2002/0097124 | A1 | 7/2002 | Inoue et al. | |
| 2003/0001718 | A1 | 1/2003 | Inoue et al. | |
| 2004/0207954 | A1 | 10/2004 | Inoue et al. | |
| 2004/0209120 | A1 | 10/2004 | Inoue et al. | |
| 2012/0092106 | A1 * | 4/2012 | Takahashi et al. | 335/302 |

FOREIGN PATENT DOCUMENTS

| | | | |
|---|---|---|---|
| CN | 1224899 | A | 8/1999 |
| CN | 1321991 | A | 11/2001 |
| JP | 06-342714 | A | 12/1994 |
| JP | H07-211531 | * | 8/1995 |
| JP | 1998-079302 | A | 3/1998 |
| JP | 10-144512 | A | 5/1998 |
| JP | 11-097228 | A | 4/1999 |
| JP | 2000-331814 | A | 11/2000 |
| JP | 2001-011563 | A | 1/2001 |
| JP | 2003-160847 | A | 6/2003 |
| JP | 2004-214418 | * | 7/2004 |
| JP | 2007-299871 | * | 11/2007 |

OTHER PUBLICATIONS

English Machine Translation of JP 2007-299871.*

English Machine Translation of JP 2004-214418.*

English Machine Translation of JP H07-211531.*

International Search Report issued in International Patent Application No. PCT/JP2011/003666 dated Sep. 22, 2011.

English translation of Chinese Search Report issued in Chinese Application No. 201180031448.4 dated May 6, 2014.

* cited by examiner

*Primary Examiner* — Jie Yang

(74) *Attorney, Agent, or Firm* — McDermott Will & Emery LLP

(57) ABSTRACT

A composite magnetic material manufactured by mixing a metal magnetic powder with an insulating binder to produce a mixed powder, press-molding the mixed powder to produce a molded product, and heat-treating the molded product in an oxidizing atmosphere at not lower than 80° C. and not higher than 400° C. to form an oxide film on a surface of the molded product. The metal magnetic powder includes Si, Fe, and component A, and the composition thereof satisfies 5.5%≤Si≤9.5%, 10%≤Si+component A≤13.5%, and the remainder is Fe, where % denotes weight %. The component A includes at least one of Ni, Al, Ti, and Mg.

11 Claims, No Drawings

COMPOSITE MAGNETIC MATERIAL AND PROCESS FOR PRODUCTION

RELATED APPLICATIONS

This application is the U.S. National Phase under 35 U.S.C. §371 of International Application No. PCT/JP2011/003666, filed on Jun. 28, 2011, which in turn claims the benefit of Japanese Application No. 2010-148739, filed on Jun. 30, 2010, the disclosures of which Applications are incorporated by reference herein.

TECHNICAL FIELD

The present invention relates to a composite magnetic material used for an inductor, a choke coil, a transformer, or the like, of electronic apparatuses, and a process for production thereof.

BACKGROUND ART

Recently, electric and electronic apparatuses have had smaller sizes and have been used in a higher frequency. In an inductance component that is one of important electronic components used in such apparatuses, high performance magnetic materials capable of achieving magnetic elements having a small size and high efficiency have been required. Thus, for a choke coil or the like used in a high frequency region, a ferrite core or a dust core is used as the magnetic material. Among them, the ferrite core formed of relatively low-price metallic oxide has a low saturated magnetic flux density. The dust core produced by molding a metal magnetic powder has a remarkably high saturated magnetic flux density as compared with that of the ferrite core. However, the dust core has a large core loss. The core loss includes a hysteresis loss and an eddy current loss. The eddy current loss is increased in proportion to the square of the frequency and the square of the size of eddy-current flow. In order to suppress generation of the eddy current, it is known to cover the surface of the metal magnetic powder with electric insulating resin or the like. On the other hand, the hysteresis loss is increased when the dust core is molded at a pressure of not less than several ton/cm$^2$. This is because distortion of the dust core as the magnetic material is increased and, at the same time, the relative magnetic permeability is reduced. In order to prevent the increase in the hysteresis loss, as described in, for example, Patent Literature 1, it is known that heat annealing treatment is carried out after the dust core is molded.

In general, as a soft magnetic alloy powder contains more iron (Fe) components, it has a higher saturated magnetic flux density and therefore is advantageous in a direct superposition property. On the other hand, as the more Fe components are contained, rust is generated at a high temperature and a high humidity. When a magnetic element is mounted on a circuit board and the rust drops on the board, circuit operation failure may occur.

The surface of the metal magnetic powder is covered with an organic electric insulating material, an inorganic electric insulating material, or the like. However, when a molded product is released from a mold at the time of press-molding of the dust core, the insulating material on the side surface of the molded product which is brought into contact with a mold surface is easily peeled off. Therefore, in the final product, rust is generated remarkably in a portion on which the insulating material is peeled off. Furthermore, when the molded product has a profile shape and a larger size, for example, when the molded product has an E-profile shape and a size of not less than 15 mm$^2$, when the molded product is released from a mold, a pulling pressure is partially concentrated for a long time as compared with a small molded product. Consequently, an insulating layer on the surface of the metal magnetic powder on the side surface of the molded product that is brought into contact with the mold is easily peeled off, and rust is easily generated.

For such problems, for example, Patent Literature 2 describes addition of Cr having a corrosion resistance effect as the magnetic alloy. However, in a case of a low-loss magnetic material that is subjected to heat treatment of not lower than 600° C., the magnetic property is remarkably lowered although the cause thereof is not clear.

Thus, it is difficult to achieve both corrosion resistance and soft magnetic property. Therefore, measures such as covering a core portion of a final product with protective coating such as resin, or filling the core portion in a protective case, or the like, are taken. However, such measures are not only disadvantageous in terms of reduction in size and cost but also insufficient in the reliability.

PATENT LITERATURE

PTL 1: Japanese Patent Application Unexamined Publication No. H6-342714

PTL 2: Japanese Patent Application Unexamined Publication No. 2003-160847

SUMMARY OF THE INVENTION

A composite magnetic material according to the present invention is a composite magnetic material manufactured by mixing a metal magnetic powder with an insulating binder to produce a mixed powder; press-molding the mixed powder to produce a molded product; and heat-treating the molded product in an oxidizing atmosphere at not lower than 80° C. and not higher than 400° C. to form an oxide film on a surface of the molded product. The metal magnetic powder includes Si, Fe, and component A, in which 5.5%≤Si≤9.5% and 10%≤Si+component A≤13.5% are satisfied and the remainder is Fe, where % denotes weight %. Component A includes at least one of Ni, Al, Ti, and Mg.

Furthermore, a process for production of a composite magnetic material according to the present invention includes: mixing a metal magnetic powder with an insulating binder to produce a mixed powder; press-molding the mixed powder to produce a molded product, and heat-treating the molded product in an oxidizing atmosphere at not lower than 80° C. and not higher than 400° C. to form an oxide film on a surface of the molded product. The metal magnetic powder includes Si, Fe, and component A, in which 5.5%≤Si≤9.5% and 10%≤Si+component A≤13.5% are satisfied and the remainder is Fe, where % denotes weight %. Component A includes at least one of Ni, Al, Ti, and Mg.

Therefore, even with a composition of, for example, a metal magnetic powder, which includes many iron (Fe) components and is easily rusted, a composite magnetic material having an excellent direct superposition property and corrosion resistance, and a process for production thereof can be achieved.

DETAILED DESCRIPTION OF THE PREFERRED EMBODIMENT

Hereinafter, an example of a process for production of a composite magnetic material in accordance with one exemplary embodiment of the present invention is described. The process for production of a composite magnetic material includes mixing a metal magnetic powder with an insulating binder to obtain a mixed powder; press-molding the mixed powder to produce a molded product, and heat-treating the molded product in an oxidizing atmosphere at not lower than 80° C. and not higher than 400° C. to form an oxide film on the surface of the molded product.

The metal magnetic powder to be used includes Si, Fe, and component A. In particular, 5.5%≤Si≤9.5% and 10%≤Si+component A≤13.5% are satisfied and the remainder is Fe where % denotes weight %. Component A includes at least one of Ni, Al, Ti, and Mg.

When a composite magnetic material of this exemplary embodiment is manufactured, firstly, a metal magnetic powder and an insulating binder are mixed with each other. The mixed product is kneaded together with a solvent such as toluene. At this time, if necessary, an auxiliary agent or the like may be added. The insulating binder is configured to cover the surface of the metal magnetic powder, and it remains as an insulating material after heat-treating at a high temperature. Thus, it plays a role of preventing rust generated when the metal magnetic powder is brought into contact with the outside air after press-molding and heat treatment are carried out.

Furthermore, it is preferable that component A includes at least Al. It is more preferable that component A is composed of Al. When the metal magnetic powder includes Al, as compared with the other elements, a stable oxide film is easily formed without loss of the magnetic property. Furthermore, it is preferable that the metal magnetic powder has an average particle diameter of not less than 1 μm and not more than 100 μm. When the metal magnetic powder having the average particle diameter within the above-mentioned range is used, an eddy current can be reduced, and a composite magnetic material exhibiting an excellent magnetic property in a high frequency region can be obtained. When the average particle diameter is less than 1 μm, the molding density of the molded product is lowered, and the relative magnetic permeability is reduced. On the other hand, when the average particle diameter is more than 100 μm, an eddy current loss in a high frequency region is increased. It is more preferable that the average particle diameter is not more than 50 μm. Thus, a composite magnetic material having a more excellent magnetic property can be obtained.

It is preferable that silane-based, titanium-based, chromium-based, and aluminum-based coupling agents, silicone resin, and the like, are used as the insulating binder. Since these materials remain as oxide after heat treatment is carried out at high temperature, they have a high effect as an insulating material. Furthermore, epoxy resin, acrylic resin, butyral resin, phenol resin, and the like, can be added as the auxiliary agent.

Furthermore, various oxides such as aluminum oxide, titanium oxide, zirconium oxide and magnesium oxide, various nitrides such as boron nitride, silicon nitride and aluminum nitride, various minerals such as talc, mica and kaolin can be further added to the metal magnetic powder. The addition of these materials further improves the insulating property. However, it is preferable that the content of these materials is up to about 15 vol %.

Next, the mixed powder obtained by mixing the metal magnetic powder and the insulating binder is filled in a predetermined mold and press-molded to form a molded product. It is preferable that the pressure at the time of press-molding is about 5 to 15 ton/cm$^2$. When the mold is released after pressing, the molded product and the mold rub each other, so that the metal magnetic powder is exposed on the surface of the molded product, from which rust may be generated.

Next, the molded product is subjected to oxidation treatment in an oxidizing atmosphere after molding, and thereby a stable oxide film can be formed on the surface of the molded product. Even in a composite magnetic material using a metal magnetic powder having a composition in which many Fe components of soft magnetic alloy powder are contained and rust is easily generated, it is possible to prevent rust from being generated and dropping off. The temperature condition of heat treatment in the oxidizing atmosphere is preferably not lower than 80° C. and not higher than 400° C. The oxidation treatment at higher than 400° C. is not preferable because diffusion of oxygen or the like deteriorates the magnetic property of the metal magnetic powder. Furthermore, oxidation treatment at lower than 80° C. is not preferable because an oxide film cannot be formed sufficiently. Furthermore, the oxidizing atmosphere herein denotes an air atmosphere. However, the oxidizing atmosphere is not necessarily limited to an air atmosphere, but any atmospheres may be employed as long as an oxygen concentration is not less than an equilibrium oxygen concentration of component A at the oxidation treatment temperature. In particular, it is preferable that the oxygen concentration is not less than 0.1 atm %. When oxidation treatment is carried out in such atmospheres, an oxide film can be formed on the surface of the molded product more stably. Furthermore, the oxidation treatment time is preferably not less than 30 minutes although depending upon the temperature conditions.

Next, the molded product on which the oxide film is formed is heat-treated in a non-oxidizing atmosphere. The heat treatment temperature is preferably not lower than 600° C. and not higher than 900° C. Furthermore, the non-oxidizing atmosphere is preferably, for example, an atmosphere of an inert gas such as nitrogen. Thus, distortion occurring in the molded product can be removed. Furthermore, the heat treatment time is preferably not less than 30 minutes although depending upon the temperature conditions.

Note here that it is more preferable that after the oxide film is formed, the entire molded product is covered with resin and the like by methods such as impregnation and molding. Since the oxide film and a resin layer are formed together, high corrosion resistance is obtained.

Furthermore, the heat-treating in the oxidizing atmosphere may be carried out after the press-molding, and may be carried out before or after the heat-treating in the non-oxidizing atmosphere.

Furthermore, it is preferable that the saturated magnetic flux density of the composite magnetic material is not less than 0.9 T. When the composite magnetic material has such characteristics, it exhibits an excellent direct superposition property.

Furthermore, the thickness of the oxide film formed in the heat-treating in the oxidizing atmosphere is preferably not less than 30 nm and not more than 200 nm. When the molded product is released from the mold at the time of press-molding, even if an insulating material on the side surface of the molded product that is brought into contact with the mold surface is peeled off, when the thickness of the oxide film formed by the heat-treating is not less than 30 nm and not more than 200 nm, a composite magnetic material that is excellent in corrosion resistance can be obtained without loss of the magnetic property.

Hereinafter, a process for production of a composite magnetic material in accordance with this exemplary embodiment is described with reference to specific Examples.

EXAMPLE 1

In this Example, a plurality of composite magnetic materials using metal magnetic powders having different compositions are produced.

Firstly, various metal magnetic powders described in samples Nos.1 to 61 shown in Table 1 are prepared. To 100 parts by weight of the prepared metal magnetic powder, 0.5 parts by weight of silicone resin as an insulating binder and 1.0 part by weight of butyral resin as an auxiliary binding agent are added, and a small amount of toluene is then added. The obtained product is mixed and kneaded. Then, the mixed and kneaded product is allowed to pass through a sieve so that the particle size is adjusted. Thus, a mixed powder is formed. The obtained mixed powder is filled in a predetermined mold and press-molded at 12 ton/cm$^2$ to form a molded product. The obtained molded product is subjected to heat treatment in an air atmosphere at 340° C. for 60 minutes to form an oxide film on the surface of the molded product. Thereafter, heat treatment is carried out in a nitrogen atmosphere at 780° C. for 30 minutes. Note here that a toroidal core-shaped molded product having an outer diameter of 14 mm, an inner diameter of 10 mm, and a height of 2 mm, approximately, and an E-core shaped molded product having a side of 15 mm and a height of 5 mm, approximately, are produced for each sample. The toroidal core-shaped molded product is used for measurement of the magnetic property, and the E-core shaped molded product is used for the corrosion resistance test.

The magnetic property and the corrosion resistance of each of the produced samples are measured. For the magnetic property, the relative magnetic permeability and the core loss are measured. The relative magnetic permeability is measured in a measuring frequency of 10 kHz by using an LCR meter. Furthermore, the core loss is measured in a measuring frequency of 120 kHz and at a measuring magnetic flux density of 0.1 T by using an alternating current BH curve measuring apparatus. Note here that evaluation standards of each measurement result preferably include the relative magnetic permeability of not less than 40 and the core loss of not more than 1500 kW/m$^3$ when the use in the high frequency region is taken into consideration although depending upon the applications of use.

Furthermore, the corrosion resistance is measured by a corrosion resistance test which is carried out in high temperature and high humidity conditions at a temperature of 85° C. and humidity of 85% for 1000 hours of test time. The results are evaluated by examining the appearance of the molded product that has undergone the test by examination under an optical microscope and visual examination. A sample in which rust is not found in the examination under an optical microscope and in the visual examination is evaluated as "best," a sample in which rust is found in examination under an optical microscope but not found in macroscopic examination is evaluated as "good," and a sample in which rust is found in the examination under an optical microscope and in macroscopic examination is evaluated as "failure." In samples in which rust is not found in macroscopic examination, that is, samples evaluated as "best" and "good" in the corrosion resistance test in a state in which samples are mounted on the circuit board, dropping of rust onto the board does not occur, which do not pose practical problems.

Results of the measurement of the magnetic property and the corrosion resistance test for each sample are shown in Tables 1A and 1B.

TABLE 1A

| S. No. | average particle diameter (μm) | Si (wt %) | "A" (wt %) | Si + "A" (wt %) | Fe (wt %) | core loss (kW/m$^3$) | relative magnetic permeability | rust | type |
|---|---|---|---|---|---|---|---|---|---|
| 1 | 12 | 5.0 | Ni 5.0 | 10.0 | R | 1860 | 70 | good | C. Ex. |
| 2 | 12 | 5.0 | Ni 8.5 | 13.5 | R | 1770 | 61 | best | C. Ex. |
| 3 | 12 | 5.5 | Ni 4.0 | 9.5 | R | 1730 | 74 | failure | C. Ex. |
| 4 | 12 | 5.5 | Ni 4.5 | 10.0 | R | 1290 | 67 | best | Ex. |
| 5 | 12 | 5.5 | Ni 8.0 | 13.5 | R | 1450 | 63 | best | Ex. |
| 6 | 12 | 5.5 | Ni 8.5 | 14.0 | R | 1620 | 34 | best | C. Ex. |
| 7 | 12 | 7.5 | Ni 2.5 | 10.0 | R | 830 | 71 | best | Ex. |
| 8 | 12 | 7.5 | Ni 6.0 | 13.5 | R | 510 | 66 | best | Ex. |
| 9 | 12 | 9.5 | Ni 0.0 | 9.5 | R | 970 | 57 | failure | C. Ex. |
| 10 | 12 | 9.5 | Ni 0.5 | 10.0 | R | 1350 | 53 | best | Ex. |
| 11 | 12 | 9.5 | Ni 4.0 | 13.5 | R | 1080 | 42 | best | Ex. |
| 12 | 12 | 9.5 | Ni 4.5 | 14.0 | R | 800 | 33 | best | C. Ex. |
| 13 | 12 | 10.0 | Ni 3.5 | 13.5 | R | 890 | 31 | best | C. Ex. |
| 14 | 12 | 10.0 | Ni 0.0 | 10.0 | R | 1240 | 54 | good | C. Ex. |
| 15 | 12 | 5.0 | Al 5.0 | 10.0 | R | 1820 | 72 | good | C. Ex. |
| 16 | 12 | 5.0 | Al 8.5 | 13.5 | R | 1740 | 64 | best | C. Ex. |
| 17 | 12 | 5.5 | Al 4.0 | 9.5 | R | 1680 | 75 | failure | C. Ex. |
| 18 | 12 | 5.5 | Al 4.5 | 10.0 | R | 1270 | 70 | best | Ex. |
| 19 | 12 | 5.5 | Al 8.0 | 13.5 | R | 1420 | 67 | best | Ex. |
| 20 | 12 | 5.5 | Al 8.5 | 14.0 | R | 1580 | 37 | best | C. Ex. |
| 21 | 12 | 7.5 | Al 2.5 | 10.0 | R | 810 | 74 | best | Ex. |
| 22 | 12 | 7.5 | Al 6.0 | 13.5 | R | 480 | 68 | best | Ex. |
| 23 | 12 | 9.5 | Al 0.0 | 9.5 | R | 970 | 57 | failure | C. Ex. |
| 24 | 12 | 9.5 | Al 0.5 | 10.0 | R | 1320 | 56 | best | Ex. |
| 25 | 12 | 9.5 | Al 4.0 | 13.5 | R | 1040 | 43 | best | Ex. |
| 26 | 12 | 9.5 | Al 4.5 | 14.0 | R | 770 | 37 | best | C. Ex. |
| 27 | 12 | 10.0 | Al 3.5 | 13.5 | R | 870 | 34 | best | C. Ex. |
| 28 | 12 | 10.0 | Al 0.0 | 10.0 | R | 1240 | 54 | good | C. Ex. |

S. No. = Sample Number
"A" = component A
R = remainder
Ex. = Example
C. Ex. = Comparative Example

TABLE 1B

| S. No. | average particle diameter (μm) | Si (wt %) | "A" (wt %) | Si + "A" (wt %) | Fe (wt %) | core loss (kW/m$^3$) | relative magnetic permeability | rust | type |
|---|---|---|---|---|---|---|---|---|---|
| 29 | 12 | 5.0 | Ti 5.0 | 10.0 | R | 1920 | 66 | good | C. Ex. |
| 30 | 12 | 5.0 | Ti 8.5 | 13.5 | R | 1860 | 59 | best | C. Ex. |
| 31 | 12 | 5.5 | Ti 4.0 | 9.5 | R | 1790 | 68 | failure | C. Ex. |
| 32 | 12 | 5.5 | Ti 4.5 | 10.0 | R | 1340 | 63 | best | Ex. |
| 33 | 12 | 5.5 | Ti 8.0 | 13.5 | R | 1470 | 61 | best | Ex. |
| 34 | 12 | 5.5 | Ti 8.5 | 14.0 | R | 1660 | 32 | best | C. Ex. |
| 35 | 12 | 7.5 | Ti 2.5 | 10.0 | R | 860 | 69 | best | Ex. |
| 36 | 12 | 7.5 | Ti 6.0 | 13.5 | R | 530 | 61 | best | Ex. |
| 37 | 12 | 9.5 | Ti 0.0 | 9.5 | R | 970 | 57 | failure | C. Ex. |
| 38 | 12 | 9.5 | Ti 0.5 | 10.0 | R | 1380 | 51 | best | Ex. |
| 39 | 12 | 9.5 | Ti 4.0 | 13.5 | R | 1110 | 41 | best | Ex. |
| 40 | 12 | 9.5 | Ti 4.5 | 14.0 | R | 850 | 31 | best | C. Ex. |
| 41 | 12 | 10.0 | Ti 3.5 | 13.5 | R | 960 | 30 | best | C. Ex. |
| 42 | 12 | 10.0 | Ti 0.0 | 10.0 | R | 1240 | 54 | good | C. Ex. |
| 43 | 12 | 5.0 | Mg 5.0 | 10.0 | R | 1890 | 67 | good | C. Ex. |
| 44 | 12 | 5.0 | Mg 8.5 | 13.5 | R | 1830 | 61 | best | C. Ex. |
| 45 | 12 | 5.5 | Mg 4.0 | 9.5 | R | 1760 | 70 | failure | C. Ex. |
| 46 | 12 | 505 | Mg 4.5 | 10.0 | R | 1310 | 66 | best | Ex |
| 47 | 12 | 5.5 | Mg 8.0 | 13.5 | R | 1450 | 64 | best | Ex. |
| 48 | 12 | 5.5 | Mg 8.5 | 14.0 | R | 1640 | 33 | best | C. Ex. |
| 49 | 12 | 7.5 | Mg 2.5 | 10.0 | R | 860 | 69 | best | Ex. |
| 50 | 12 | 7.5 | Mg 6.0 | 13.5 | R | 510 | 65 | best | Ex. |
| 51 | 12 | 9.5 | Mg 0.0 | 9.5 | R | 970 | 57 | failure | C. Ex. |
| 52 | 12 | 9.5 | Mg 0.5 | 10.0 | R | 1390 | 52 | best | Ex. |
| 53 | 12 | 9.5 | Mg 4.0 | 13.5 | R | 1090 | 40 | best | Ex. |
| 54 | 12 | 9.5 | Mg 4.5 | 14.0 | R | 810 | 31 | best | C. Ex. |
| 55 | 12 | 10.0 | Mg 3.5 | 13.5 | R | 930 | 30 | best | C. Ex. |
| 56 | 12 | 10.0 | Mg 0.0 | 10.0 | R | 1240 | 54 | good | C. Ex. |
| 57 | 0.8 | 7.0 | Ni 5.0 | 12.0 | R | 380 | 38 | best | C. Ex. |
| 58 | 1 | 7.0 | Ni 5.0 | 12.0 | R | 400 | 67 | best | Ex. |
| 59 | 50 | 7.0 | Ni 5.0 | 12.0 | R | 570 | 73 | best | Ex. |
| 60 | 100 | 7.0 | Ni 5.0 | 12.0 | R | 1370 | 85 | best | Ex. |
| 61 | 110 | 7.0 | Ni 5.0 | 12.0 | R | 1720 | 87 | best | C. Ex. |

S. No. = Sample Number
"A" = component A
R = remainder
Ex. = Example
C. Ex. = Comparative Example As is apparent from the results shown in Tables 1A and 1B, it is shown that the composite magnetic materials exhibit an excellent magnetic property and corrosion resistance when the metal magnetic powder includes Si, Fe, and component A, in which the composition satisfies 5.5%≤Si≤9.5% and 10%≤Si+component A≤13.5% and the remainder is Fe where % denotes weight %, and component A includes at least one of Ni, Al, Ti, and Mg.

Furthermore, in particular, when the composition of the metal magnetic powder satisfies 5.5%≤Si≤7.5% and 10%≤Si+component A≤13.5% and the remainder is Fe where % denotes weight %, and component A includes at least one of Ni, Al, Ti, and Mg, the magnetic property that is excellent in higher magnetic permeability and corrosion resistance are shown.

Also when component A includes two or more of Ni, Al, Ti, and Mg, when the entire metal magnetic powder has a composition range of 10%≤Si+component A≤13.5%, needless to say, the same effect can be obtained. Furthermore, when the metal magnetic powder contains a small amount of impurities or additives, but when the content thereof is within several percents, needless to say, the same effect can be obtained.

EXAMPLE 2

In this Example, a plurality of samples having different saturated magnetic flux densities are produced by changing pressures at the time of formation of a molded product.

A metal magnetic powder having an average particle diameter of a composition including 5.0% of Ni, 7.5% of Si, and Fe as the remainder, where % denotes weight %, is prepared. Then, to 100 parts by weight of the metal magnetic powder, 1.5 parts by weight of silicone resin as an insulating binder is added, and then a small amount of toluene is added. The obtained product is mixed and kneaded. Then, the mixed and kneaded product is allowed to pass through a sieve so that the particle size is adjusted, and a mixed powder is formed. The obtained mixed powder is filled in a predetermined mold. Each of samples Nos. 62 and 63 is press-molded at a pressure of 5 to 15 ton/cm$^2$ so as to produce a molded product. The obtained molded product is subjected to oxidation treatment in an air atmosphere at 280° C. for 90 minutes so as to form an oxide film on the surface of the molded product. Thereafter, heat treatment is carried out in a nitrogen atmosphere at 820° C. for 30 minutes. Thus, a plurality of samples having different saturated magnetic flux densities are produced.

The molded product is formed in a toroidal core shape having an outer diameter of 14 mm, an inner diameter of 10 mm and a height of 2 mm, approximately.

The relative magnetic permeability, core loss, direct superposition property and saturated magnetic flux density are measured for each sample. The relative magnetic permeability is measured in a measuring frequency of 10 kHz by using an LCR meter. The core loss is measured in a measuring frequency of 120 kHz and at a measuring magnetic flux density of 0.1 T by using an alternating current BH curve measuring apparatus. The direct superposition property is evaluated by obtaining the change rate of the relative magnetic permeability at the time when the direct magnetic field is 2400 A/m in a measuring frequency of 10 kHz by using an LCR meter. As the saturated magnetic flux density, a value is measured at the time when the magnetic field is 1.2 MA/m by using a VSM (vibrating sample magnetometer). Note here that it is preferable that the evaluation standards of each measurement result include the relative magnetic permeability of not less than 40, the core loss of not more than 1500 kW/m$^3$, and the change rate of the direct superposition property of not less than 60%, when the use in the high frequency region taken into consideration although depending upon the applications of use.

Measurement results of each sample are shown in Table 2.

TABLE 2

| Sample No | saturated magnetic flux density (T) | core loss (kW/m$^3$) | relative magnetic permeability | change rate of direct superposition property (%) | type |
|---|---|---|---|---|---|
| 62 | 0.88 | 420 | 66 | 57 | C. Ex. |
| 63 | 0.90 | 380 | 68 | 63 | Ex |

As is apparent from the results shown in Table 2, when the saturated magnetic flux density of the composite magnetic material is not less than 0.9 T, excellent direct superposition is exhibited. This is because magnetic core is not easily saturated due to the high saturated magnetic flux density when direct superposition is applied.

EXAMPLE 3

In this Example, a plurality of samples are produced by changing heat treatment temperatures in heat treatment under an oxidizing atmosphere and heat treatment temperatures in a non-oxidizing atmosphere.

A metal magnetic powder having an average particle diameter of 25 μm, a composition including 4.5% of Al, 6.5% of Si, and Fe as the remainder, where % denotes weight %, is prepared. Then, to 100 parts by weight of the prepared metal magnetic powder, 0.9 parts by weight of silicone resin as an insulating binder and 1.0 part by weight of acrylic resin as a binding auxiliary agent are added, respectively. Then, a small amount of toluene is added. The obtained product is mixed and kneaded. Then, the particle size is adjusted, and a mixed powder is produced. The obtained mixed powder is filled in a predetermined mold and pressed at a pressure of 10 ton/cm$^2$ so as to produce a molded product. Thereafter, based on each temperature condition shown in Table 3, the molded product is subjected to oxidation treatment in an oxidizing atmosphere and to heat-treatment in a non-oxidizing atmosphere, respectively. Note here that the oxidation treatment time is 90 minutes, and heat treatment time is 30 minutes. A toroidal core-shaped molded product having an outer diameter of 14 mm, an inner diameter of 10 mm, and a height of 2 mm, approximately, which is used for measurement of the magnetic property, and an E-core shaped molded product having a side of 15 mm and a height of 5 m, approximately, which is used for the corrosion resistance test, are produced.

Measurement of the magnetic property and the corrosion resistance test are carried out and evaluated by the same methods as those in Example 1. Each measurement result is shown in Table 3.

TABLE 3

| Sample No | oxidation treatment temperature (° C.) | heat treatment temperature (° C.) | core loss (kW/m$^3$) | relative magnetic permeability | rust | type |
|---|---|---|---|---|---|---|
| 64 | 70 | 800 | 670 | 68 | good | C. Ex. |
| 65 | 80 | 800 | 640 | 65 | best | Ex. |
| 66 | 120 | 800 | 700 | 67 | best | Ex. |
| 67 | 400 | 800 | 850 | 66 | best | Ex. |
| 68 | 410 | 800 | 1820 | 56 | best | C. Ex. |
| 69 | 300 | 580 | 2100 | 65 | best | C. Ex. |
| 70 | 300 | 600 | 750 | 67 | best | Ex. |
| 71 | 300 | 900 | 550 | 68 | best | Ex. |
| 72 | 300 | 920 | 1800 | 84 | best | C. Ex. |

From Table 3, it is shown that samples 65 to 67 and 70 to 71 of the composite magnetic materials, which are manufactured by carrying out oxidation treatment in an oxidizing atmosphere in the temperature range of not lower than 80° C. and not higher than 400° C. and by carrying out heat treatment in a non-oxidizing atmosphere in the temperature range of not lower than 600° C. and not higher than 900° C., show excellent magnetic property and corrosion resistance. This is because when treatment is carried out in the above-mentioned temperature range, distortion in the molded product generated at the time of formation can be removed in the heat treatment, and a stable oxide film can be formed on the surface of the metal magnetic powder in the oxidation treatment.

EXAMPLE 4

In this Example, a plurality of samples are produced by changing a treatment time in the oxidation treatment.

A metal magnetic powder having an average particle diameter of 23 μm, a composition including 5.0% of Al, 6.5% of Si, and Fe as the remainder, where % denotes weight %, is prepared. To 100 parts by weight of the prepared metal magnetic powder, 1.2 parts by weight of silicone resin as an insulating binder is added, and then a small amount of toluene is added. The obtained product is mixed and dispersed so as to obtain a mixed powder. The obtained mixed powder is filled in a predetermined mold and pressed at a pressure of 13 ton/cm$^2$ to produce a molded product. Thereafter, the molded product is subjected to oxidation treatment in an air atmosphere at 380° C. while the treatment time is changed. Furthermore, heat treatment is carried out in the nitrogen atmosphere at 840° C. for 30 minutes. A toroidal core-shaped molded product having an outer diameter of 14 mm, an inner diameter of 10 mm, and a height of 2 mm, approximately, is produced for measuring the magnetic property, and an E-core shaped molded product having a side of 15 mm and a height of 5 mm, approximately, is produced for the corrosion resistance test for each sample.

In evaluation of the thickness of the oxide film, the thickness of a metal oxide film exposed to the core outermost surface that is brought into contact with the mold surface of the E-core shape as a final product is measured by Auger electron spectroscopy (AES) and evaluated. The measurement of the magnetic property and the corrosion resistance test, other than the above, are carried out in the same measurement conditions as those in Example 1. Measurement results are shown in Table 4.

TABLE 4

| Sample No | thickness of oxide film (nm) | core loss ($kW/m^3$) | relative magnetic permeability | rust | type |
|---|---|---|---|---|---|
| 73 | 18 | 1250 | 68 | failure | C. Ex. |
| 74 | 27 | 1230 | 65 | failure | C. Ex. |
| 75 | 30 | 1200 | 67 | best | Ex. |
| 76 | 200 | 1240 | 66 | best | Ex. |

From Table 4, it is shown that as in samples 75 to 76, when the thickness of the metal oxide film is not less than 30 nm, a stable oxide film is formed on the surface of the metal magnetic powder. Therefore, the composite magnetic material exhibits an excellent magnetic property and corrosion resistance.

INDUSTRIAL APPLICABILITY

A composite magnetic material produced by a production process according to the present invention has an excellent magnetic property and corrosion resistance, and is particularly useful as a magnetic material used in a transformer core, a choke coil, or the like.

The invention claimed is:

1. A production process of a composite magnetic material, the process comprising:

mixing a metal magnetic powder with an insulating binder to produce a mixed powder;

press-molding the mixed powder to produce a molded product, and heat-treating the molded product in an oxidizing atmosphere at not lower than 80° C. and not higher than 400° C. to form an oxide film on a surface of the molded product, wherein the metal magnetic powder includes Si, Fe, and component A, and a composition of the metal magnetic powder satisfies 5.5 wt %≤Si≤9.5 wt %, 10 wt %≤Si+component A≤13.5 wt %, and a remainder being Fe, and the component A includes at least one of Ni, Al, Ti, and Mg, and a core loss of the composite magnetic material that is measured at a measuring frequency of 120 kHz and at a measuring magnetic flux density of 0.1 T by using an alternating current BH curve measuring method is not more than 1500 $kW/m^3$.

2. The production process of claim 1, wherein the composite magnetic material has a saturated magnetic flux density of not less than 0.9 T.

3. The production process of claim 1, wherein the oxide film has a thickness of not less than 30 nm and not more than 200 nm.

4. The production process of claim 1, wherein the metal magnetic powder has an average particle diameter of not less than 1 μm and not more than 100 μm.

5. The production process of claim 1, wherein the component A is Al.

6. The production process of claim 1, further comprising heat-treating the molded product heat-treated in the oxidizing atmosphere, in a non-oxidizing atmosphere at not lower than 600° C. and not higher than 900° C.

7. The production process of claim 1, wherein the component A is at least one of Ni, Ti, and Mg.

8. The production process of claim 1, wherein the component A is two or more of Ni, Al, Ti, and Mg.

9. The production process of claim 1, wherein the heat-treating the molded product in the oxidizing atmosphere is performed at not lower than 80° C. and not higher than 120° C.

10. The production process of claim 1, wherein a relative magnetic permeability of the composite magnetic material that is measured at a measuring frequency of 10 kHz is not less than 40.

11. The production process of claim 1, wherein the core loss is 850 $kW/m^3$ or less.

* * * * *